US005193242A

United States Patent [19]

Irwin

[11] Patent Number: 5,193,242

[45] Date of Patent: Mar. 16, 1993

[54] WASTELINE CLEANOUT APPARATUS

[76] Inventor: Lawrence F. Irwin, 12860 San Fernando Rd., Sylmar, Calif. 91342

[21] Appl. No.: 720,228

[22] Filed: Jun. 24, 1991

Related U.S. Application Data

[63] Continuation of Ser. No. 448,378, Dec. 11, 1989, abandoned.

[51] Int. Cl.[5] ..... B08B 9/02

[52] U.S. Cl. ..... 15/104.33; 226/52; 15/104.31

[58] Field of Search ..... 15/104.33; 254/134.3

[56] References Cited

U.S. PATENT DOCUMENTS 3,162,878 12/1964 Agostino ..... 15/104.33
3,246,354 4/1966 Cooney et al. ..... 15/104.33
4,364,139 12/1982 Babb et al. ..... 15/104.33
4,570,281 2/1986 Boelens ..... 15/104.33
4,580,306 4/1986 Irwin ..... 15/104.33
4,686,732 8/1987 Irwin ..... 15/104.33

*Primary Examiner*—Philip R. Coe
*Assistant Examiner*—Patrick Brinson
*Attorney, Agent, or Firm*—J. E. Brunton

[57] ABSTRACT

An improved wasteline cleanout tool of the character having an elongated coiled spring housed within a drum which is rotated by a drive mechanism mounted on the rearward portion of the tool. The coiled spring is withdrawn from or inserted into the drum by a feed mechanism which is mounted on the forward portion of the tool. The forward portion of the tool can be separated from the rearward portion to facilitate replacement of the drum in a safe and relatively effortless manner.

9 Claims, 3 Drawing Sheets

FIG. 6
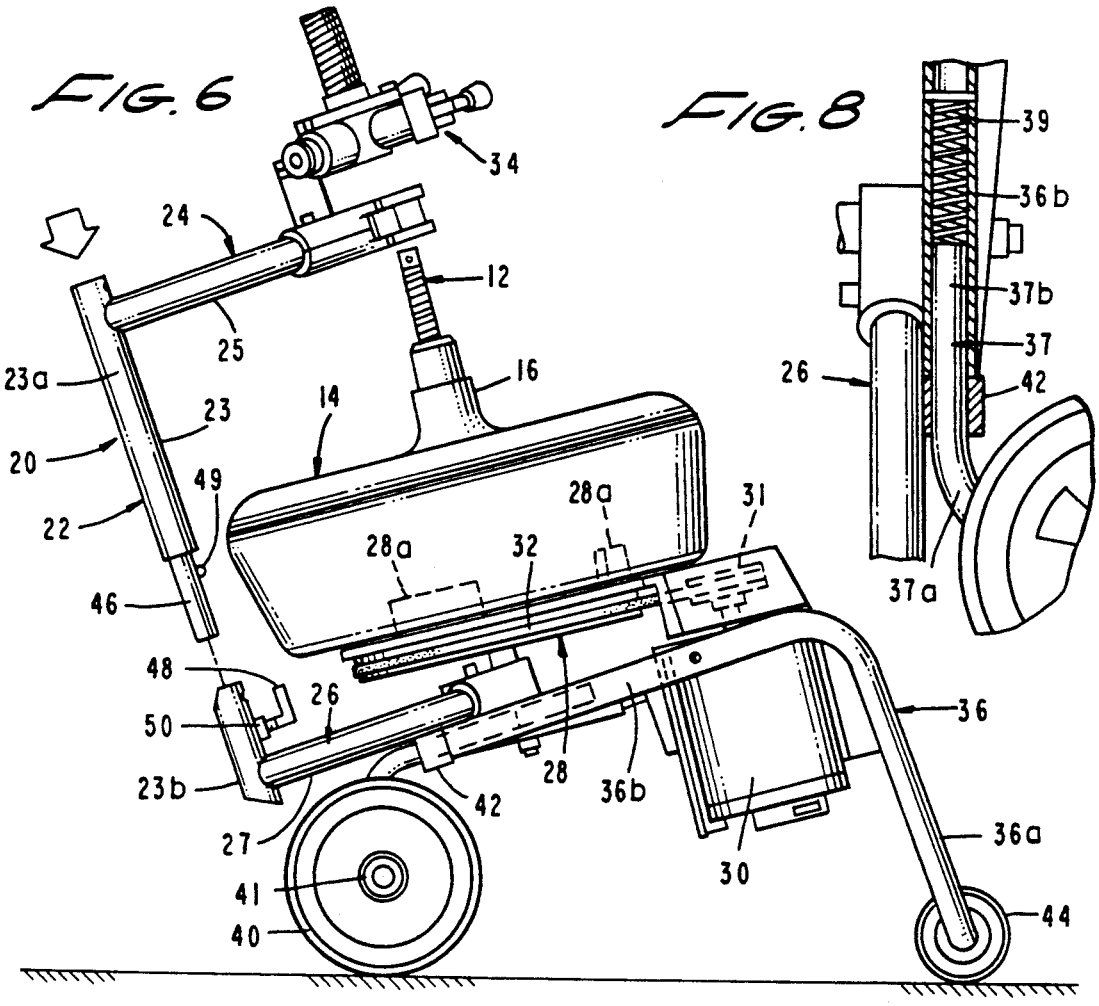
FIG. 8
FIG. 7
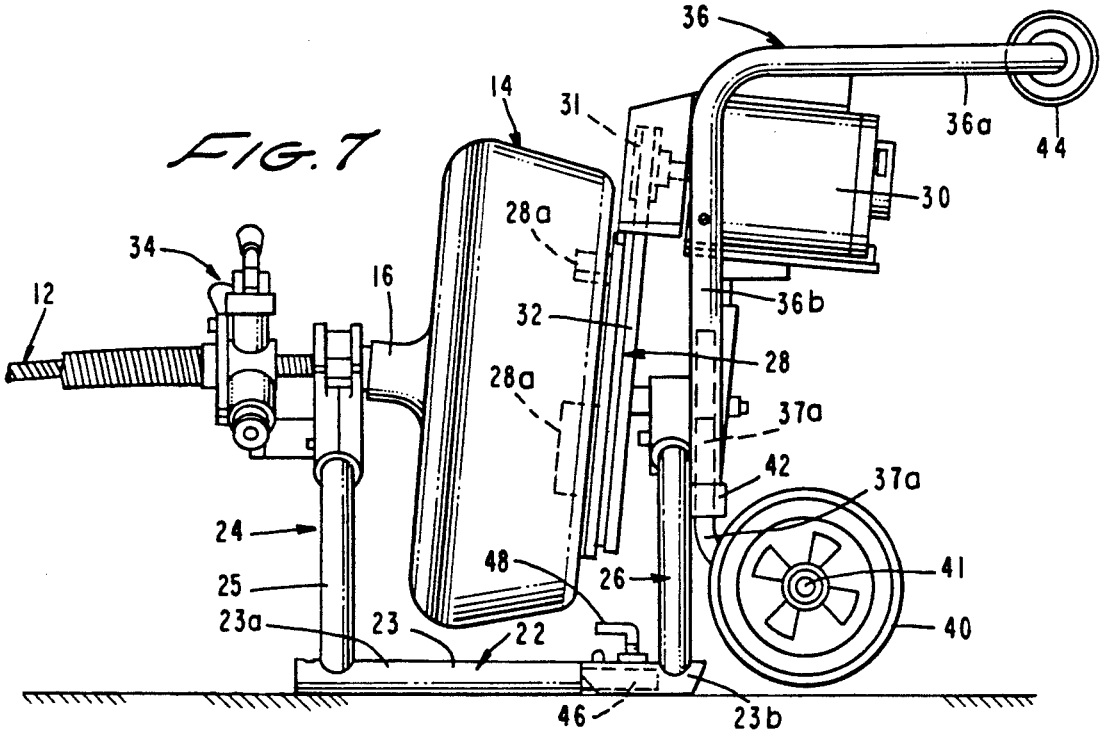

WASTELINE CLEANOUT APPARATUS

This application is a continuation of application Ser. No. 07/448,378, filed Dec. 11, 1989, and now abandoned.

BACKGROUND OF THE INVENTION

1. Field of The Invention

The present invention relates generally to plumber's tools. More particularly, the invention concerns a waste line cleanout tool adapted for cleaning and removing obstructions from waste lines wherein an elongated member in the form of a coiled spring wire, known as a plumber's snake, is housed in a removable drum from which it is advanced through the pipe and rotated.

2. Discussion of The Prior Art

Spring type plumber's snakes are ordinarily housed in a drum or container having a conoidal wall through which the spring or snake is fed and retracted axially of itself as the container is rotated to cause rotation of the spring. In tools having power operated spring advancing and retracting means, the feed mechanism typically includes jaws, rollers, segmented nuts, or like structures which grip the spring so that when the spring is fed through the feed while being rotated, it is advanced into or retracted from the sewer line.

The drum housing the spring is frequently removably mounted on a supporting frame or stand. In medium to large sized machines, the combined weight of the spring, the spring housing, the feed, the frame and the drive motor is significant. The weight of these machines has always presented handling problems for the operator.

In using the sewer cleanout apparatus, it is often necessary to increase the length of coiled spring to reach the stoppage in the sewer line. To do this, the operator must remove the empty spring housing, or drum, and add a new full drum containing an additional length of coiled spring so that the remote stoppage can be reached and cleared. When retrieving the coiled spring, the operator must remove the full drum and add an empty drum in order to retrieve the additional coiled spring still in the sewer line. Each time the operator adds or removes a full drum, he must physically lift the heavy drum to mount it on, or remove it from, the frame. Unless the operator properly lifts these heavy drums, serious injury can result.

U.S. Pat. No. 3,956,293, issued to the present inventor, discloses one type of prior art power operated wasteline cleanout apparatus having a removable coil spring storage drum. U.S. Pat. No. 3,095,592, issued to R. G. Hunt discloses an early form of power operated wasteline cleanout tool.

The thrust of the present invention is to provide a wasteline cleanout apparatus of unique design which enables the operator to add or remove full drums to the apparatus in a safe and substantially effortless manner.

SUMMARY OF THE INVENTION

It is an object of the invention to provide an improved power driven machine of the type which comprises an elongated, flexible coil spring or plumbers snake formed of helically wound spring wire which can be controllably withdrawn from the machine for insertion into the pipe to be cleaned. The machine includes a removable one-piece storage drum, or container, which can be molded of plastic, rubber or the like, in which the coil spring can conveniently be housed. The storage drum includes a generally annular shaped rear portion adapted to contain the spring in a coil configuration and a forward guide portion configured so as to engage the spring during operation of the machine and closely guide its withdrawal from and reinsertion into the storage reel. A drive hub is provided at the rear of the drum for inter-engagement with a drive means which rotates the drum about its central axis.

A particular object of the invention is to provide a wasteline cleanout machine of the aforementioned character in which the storage drum can be easily and effortlessly mated with the drive means in a much safer manner than is possible with prior art machines of similar design. This is accomplished by providing a machine which incorporate a system of lifting similar to a wheeled, tilt-up type "lift truck" fulcrum system. With this system it is possible for the operator to lift on or off the heavy drum and coiled spring with minimum effort. The base frame of the machine is separable so that the forward spring feed portion of the device can be separated from the storage drum mounting portion, thereby permitting easy access to the storage drum. With the forward spring feed portion removed, the drive-hub of the drum can be engaged by the drive means. The rear portion of the device which carries the drive means, can then be tilted about a fulcrum point in the same manner as a lift truck to lift the drum into position for easy mating with the drive means.

BRIEF DESCRIPTION OF THE DRAWINGS

FIG. 6 is an exploded side elevational view, illustrating the manner of assembly of the forward portion of the apparatus to the rearward portion of the apparatus after the storage drum has been positioned over the driving-hub of the apparatus.

FIG. 7 is a side elevational view of the apparatus, illustrating the apparatus in a fully operable configuration.

FIG. 8 is a fragmentary view partly in section illustrating the spring loaded assembly of the wheel carrying portion of the frame to the main transport assembly frame.

DESCRIPTION OF THE INVENTION

Figure 1:
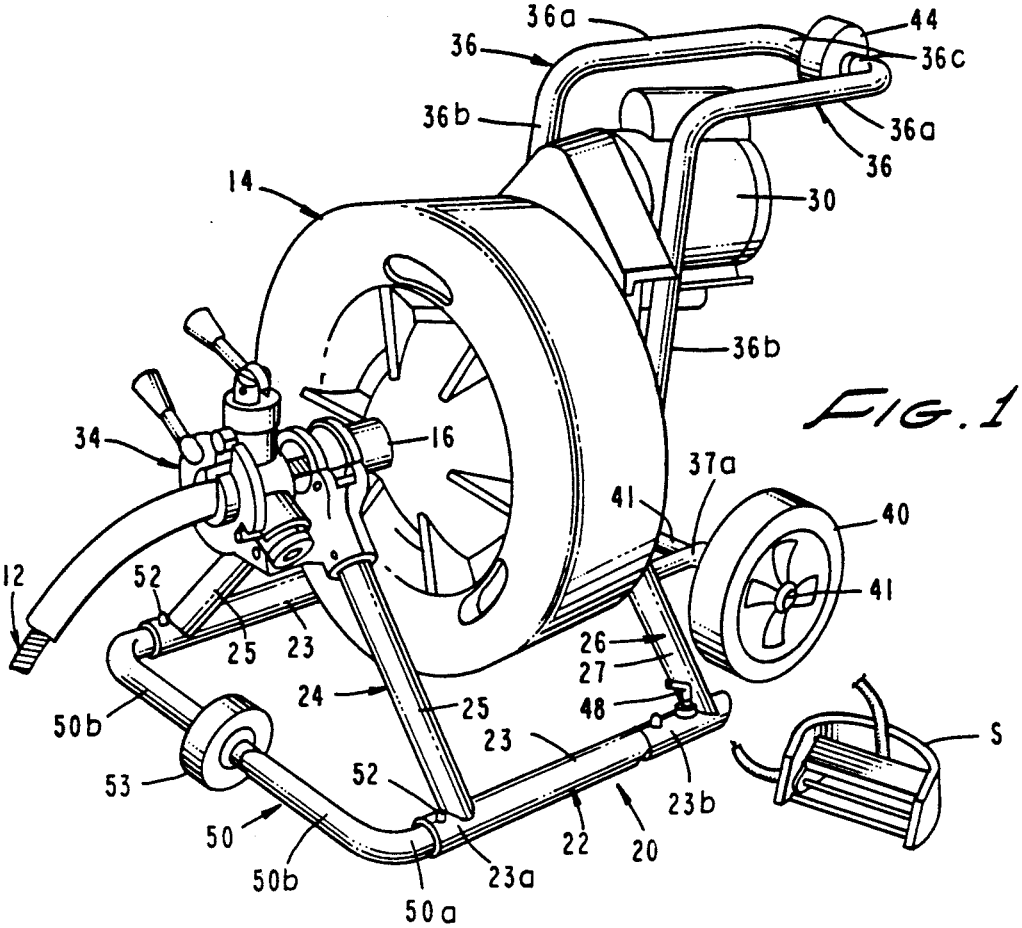
FIG. 1 is a generally perspective view of the apparatus of the present invention.
Figure 2:
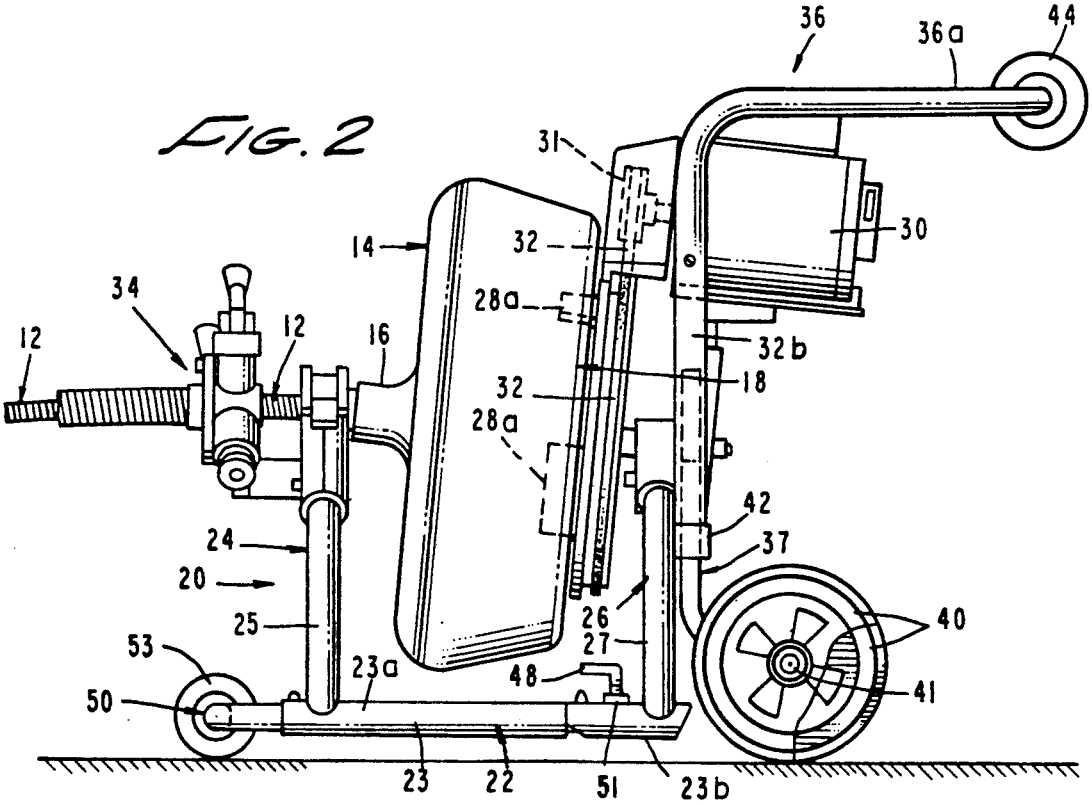
FIG. 2 is a side elevational view of the apparatus.
Figure 4:
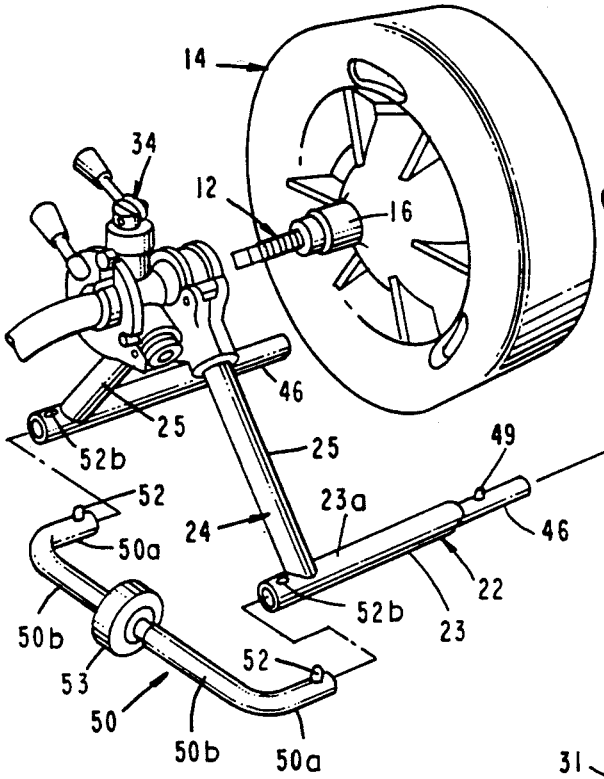
FIG. 4 is an exploded generally perspective view of one form of the apparatus of the invention.
Figure 4:
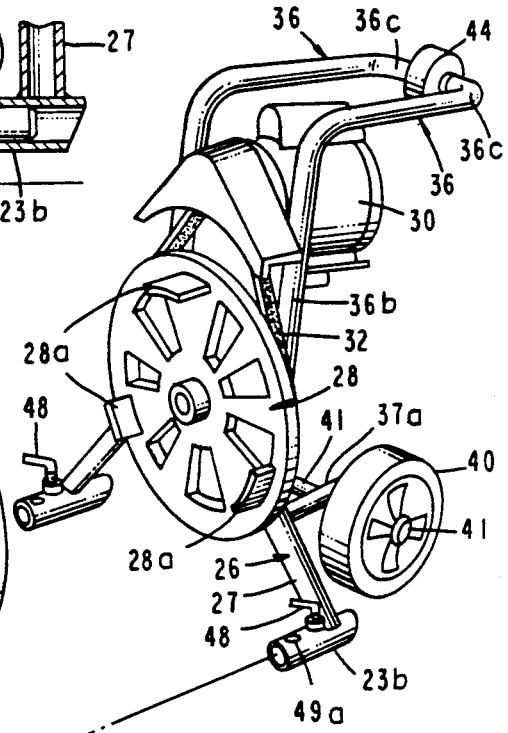

Referring to the drawings and particularly to FIGS. 1, 2 and 4, the improved Wasteline Cleanout Tool of the present invention is of the character having an elongated coiled spring or plumber's snake 12 housed within hollow drum 14. Drum 14 has forward neck portion 16 through which the coiled spring 12 can be withdrawn and a rearward drive-hub 18 (FIG. 2). The improved tool of the embodiment of the invention shown in the drawings comprises a frame 20 having a base 22, a forward upstanding portion 24 and a rearward upstanding portion 26.

As best seen by referring to FIG. 4, base 22 comprises a pair of spaced apart tubular members 23 each having a forward portion 23*a* and a rearward portion 23*b* which are releasably interconnected in a manner presently to be described.

The forward upstanding portion 24 of the frame includes a pair of angularly upwardly extending members 25 which are interconnected with tubular members 23*a* of the forward portion of the base. Similarly, the rearward portion 26 of the frame comprises a pair of angularly upwardly extending members 27 which are interconnected with tubular members 23*b* of the rearward portion of the base.

A drive means for controllably rotating drum 14 is mounted rearwardly of the rearward portion 26 of the frame and includes a drive-hub engaging means 28 (FIG. 4) for releasably engaging the drive hub 18. The drive means also includes an electric motor 30 which is driveably interconnected with the drive-hub engaging means 28 by means of a sheave 31 and a drive belt 32. Electric motor 30 is of standard construction and is adapted to rotate drive-hub engaging means 28 via sheave 31 and drive-belt 32 in either a clockwise or counter-clockwise direction.

Connected to the forward upstanding portion 24 of the frame is a feed means, generally designated by the numeral 34, for gripping engagement with coil spring or snake 12 to withdraw the coil spring from the drum upon rotation of the drum by the drive means. The feed means can comprise gripping jaws, rollers, segmented nuts or like structures which grip the spring so that it will be urged through the feed as it is rotated. The feed means shown in the drawings is of the character illustrated and described in U.S. Pat. No. 4,580,306 issued to the present inventor. Such a feed is quite suitable for use in connection with the apparatus of the present invention, but feeds of other design may also be used, so long as they permit withdrawal of the coil spring during replacement of the drum in the manner presently to be described.

Forming an important aspect of the apparatus of the present invention is a transport assembly, or frame supporting means, which is adapted to support the frame 20 and to pivot the frame from a first position shown in FIG. 1, wherein the base 22 is substantially horizontal to a second position shown in FIG. 6, wherein the base 22 extends angularly upwardly. In the form of the invention shown in the drawings, the frame supporting means comprises a pair of spaced apart tubular members 36. Each member 36 includes a rearwardly extending means, or leg, 36*a* and an upwardly extending means, or leg 36*b*.

A pair of wheels 40 are rotatably carried by an axle 41 which extends between a pair of spaced apart lower tubular legs 37 of the frame supporting means. As best seen by referring to FIGS. 7 and 8, each leg 37 includes a rearwardly extending portion 37*a* which supports axle 41 and an upwardly extending portion 37*b* which is telescopically received within the lower ends of frame portions 36*b*. As indicated in FIG. 8, coiled springs 39 are carried within frame portions 36*b*. Springs 39 engage the upper end of leg portions 37 so as to permit limited upward movement of the legs within frame portions 36*b* against the urging of the springs.

Portions 36*b* of the frame supporting means are interconnected with rearward upstanding portion 26 of the frame 20 by means of suitable connectors, such as bracketed 42 (FIG. 2). Rotatably mounted intermediate the inturned ends 36*c* of upper rearwardly extending 36*a* is a single ground engaging wheel 44 for engaging the ground when the device is in the drum loading position shown in FIG. 6.

Figure 3:
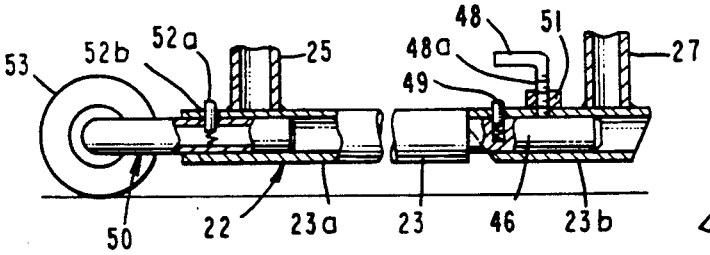
FIG. 3 is a fragmentary view, partially in cross-section, illustrating the method of inter-connection of the two part base of the apparatus.

Referring now particularly to FIGS. 3 and 4, pairs of tubular members 23*a* and 23*b* are releasably interconnected by means of connector means. In the present form of the invention the connector means comprises a cylindrical member 46 (FIG. 4) which is connected to and protrudes rearwardly from each of the forward tubular members 23*a* of the base. Cylindrical members 46 are of a diameter to be closely received within the rearward tubular members 23*b* of the base. As indicated in FIG. 3 when cylindrical members 46 are telescopically received within tubular members 23*b* they can be locked in position by an L-shaped locking member 48. Each locking member 48 has an externally threaded leg 48*a* which is threadably receivable within an internally threaded boss 50 provided on each of the tubular members 23*b*. By threading leg 48*a* of the locking member 48 into the bosses 51 the lower end of the leg will be brought into pressural engagement with the cylindrical members 46 so as to prevent their separation from tubular members 23*b*.

As a back-up safety device to prevent accidental separation of the base portions, one of the cylindrical members 46 is provided with a spring loaded detent button 49 (FIG. 4) which is receivable within an aperture 49*a* formed in one of the base members 23*b*. The combination of the spring loaded detent mechanism and the locking members 48 positively prevents accidental separation of the forward and rearward portions of the device.

As best seen in FIG. 4, a generally U-shaped member 50 is releasably interconnected with the forward portion 24 of the base. More particularly, U-shaped member 50 has cylindrically shaped, rearwardly extending legs 50*a* which are telescopically receivable within the forward ends of tubular base members 23*a*. Member 50 is held in position within the forward portion of the base by a pair of spring loaded detent mechanisms 52. Mechanisms 52 are of standard construction with the spring loaded cylindrical member 52*a* mounted within legs 50*a* and being receivable within apertures 52*b* provided in tubular base portions 23*a* (FIG. 3). Rotatably carried by the bight portion 50*b* of member 50 is a ground engaging wheel 53 which can be used in rolling the device along the ground.

Figure 5:
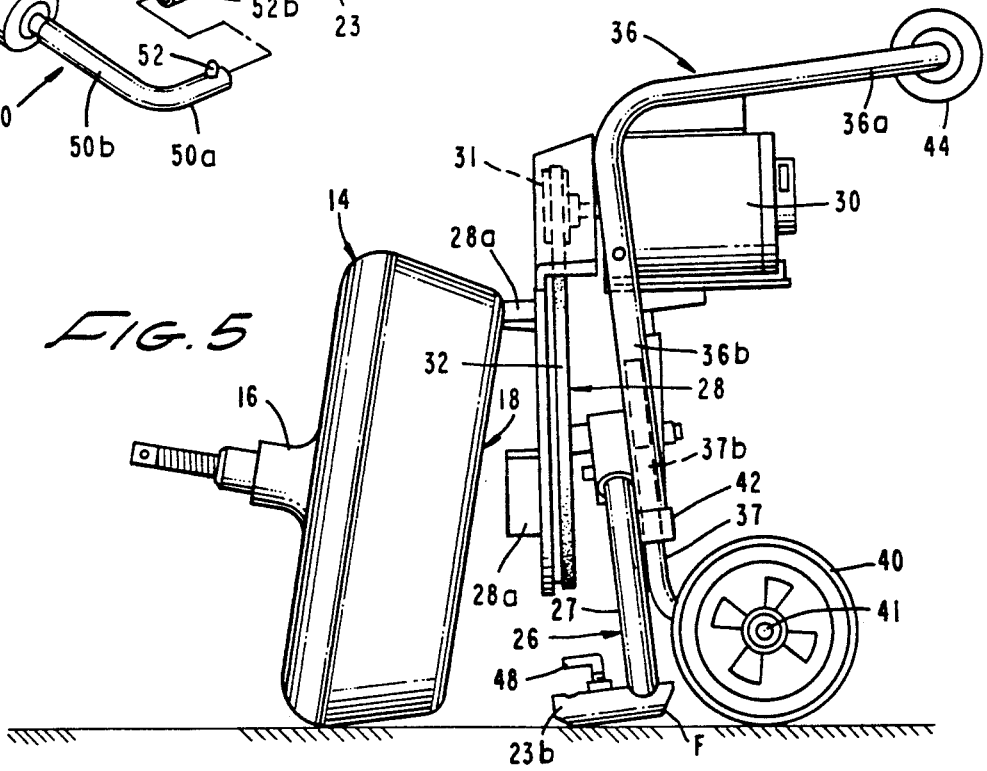
FIG. 5 is a side elevational view of the rear portion of the apparatus, illustrating the manner in which the storage drum is lifted into position onto the drive-hub of the drive mechanism apparatus.

Turning to FIG. 5, when it is necessary to replace an empty drum 14 with a fully loaded drum 14, the forward portion 24 of the device is first separated from the rearward portion 26. This is accomplished by loosening locking members 48 and sliding cylindrical members 46 free of tubular base members 23*b*. Once the forward portion of the device is separated from the rearward portion, the empty drum can be removed. The full drum is then rolled into position in the manner shown in FIG. 5 and one of the driving lugs, 28*a* of the drive means hub 28 is inserted into the rearwardly, open drive-hub of the full drum 14 in the manner shown in FIG. 5. The rearward portion of the device is then tilted upwardly about a fulcrum point F by grasping the upper hand engaging portions 36*a* of the transport assembly. This movement is similar to the tilting movement of a hand truck, or dolly. The ability of the lower portions 37*b* of the transport frame to move telescopically within frame portions 36*b*, against the urging of springs 39, substantially assists in accomplishing the tilting movement in a smooth and effortless manner. Once tilted, the rearward portion of the device is moved into the position shown in FIG. 6. In this position tubular base members 23b extend angularly upwardly and wheel 44 of the transport assembly rests on the ground along with the pair of wheels 40 which form a part of the transport assembly.

When the heavy drum has been lifted in the manner described, the drum can be easily maneuvered into a mating position with the drive means. In this position the drive lugs 28a fit internally of the rearwardly open drive-hub provided on the drum 14 and engage driving lugs disposed about the periphery of the drive-hub. Once the drum is in position and in driving engagement with the the drive means, the forward portion 24 of the device is reassembled to the rearward portion 26 by sliding cylindrical members 46 into tubular base members 23b. At the time the forward portion of the device is mated with the rearward portion, the coil spring 12 contained within the fully loaded drum is fed through the feed means 34 so that it will extend outwardly therefrom in the manner shown in FIG. 7. If desired the U-shaped member 50 along with wheel 52 can be removed from the forward portion of the frame so that the base of the frame will engage the ground in the manner shown in FIG. 7. This provides a stable foundation for the device so that using a foot switch S, of the like, the motor 30 can be actuated which, in turn, will rotate the drum and the coil spring, or snake, about its longitudinal axis. By then actuating the feed means, the coil spring 12 can be fed into or withdrawn from the sewer line which is to be cleaned.

It is to be understood that when the snake is withdrawn from the sewer line, as each drum is filled it can be removed and replaced by an empty drum, by reversing the drum loading steps described in the preceding paragraphs.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A wasteline cleanout tool of the character having an elongated coiled spring housed within a drum having a forward neck portion through which the coiled spring can be withdrawn and a rearward hub, said tool comprising:

(a) a frame having a base, including first and second removable interconnected portions, a forward portion connected to said first portion of said base and a rearward portion connected to said second base portion;

(b) feed means connected to said forward portion of said frame for removable engagement with the coiled spring to controllably withdraw the coiled spring from the drum thereof, said feed means including hub engaging means for releasable engagement with the rearward hub of the drum; and (c) frame supporting means for supporting said frame, said frame supporting means being movable about a fulcrum from a first position wherein said base of said frame extends substantially horizontally to a second position wherein said base extends angularly upwardly, said frame supporting means comprising a transport assembly having:

(i) an upper portion including hand engaging means for engagement by the hands of the operator of the tool, a pair of downwardly extending tubular members connected to said hand engaging means, and a spring mounted within each of said downwardly extending members; and (ii) a lower portion including a pair of rearwardly extending legs, a pair of wheels rotatably carried by said rearwardly extending legs and a pair of upwardly extending legs telescopically receivable within said downwardly extending tubular members for engagement with said spring, whereby a downward pressure exerted on said hand engaging means will cause telescopic movement of said upwardly extending legs within said downwardly extending tubular member against the urging of said spring.

2. A wasteline cleanout tool of the character having an elongated coiled spring housed within a drum having a forward neck portion through which the coiled spring can be withdrawn and a rearward hub, said tool comprising:

(a) a frame having a base, including first and second removably interconnected portions, a forward portion connected to said first portion of said base, and a rearward portion connected to said second base portion;

(b) feed means connected to said forward portion of said frame for removable engagement with the coiled spring to controllably withdraw the coiled spring from the drum through the forward neck portion thereof;

(c) drive means connected to said rearward portion of said frame for rotating said drum about the central axis thereof; and (d) frame supporting means for supporting said frame, said frame supporting means being movable about a fulcrum from a first position wherein said base of said frame extends substantially horizontally to a second position wherein said base extends angularly upwardly, said frame supporting means comprising a transport assembly having:

(i) a lower portion including a pair of rearwardly extending legs, and a pair of upwardly extending legs;

(ii) an upper portion including a pair of downwardly extending tubular members receivable over said upwardly extending legs of said lower portion, and biasing means for yieldably resisting upward movement of said pair of upwardly extending legs of said lower portion.

3. A wasteline cleanout tool as defined in claim 2, further including a pair of wheels rotatably carried by said rearwardly extending legs of said lower portion.

4. A wasteline cleanout tool as defined in claim 2, in which said upper portion further includes hand engaging means for engagement by the operator of the tool.

5. A wasteline cleanout tool as defined in claim 2 in which said upwardly extending legs of said lower portion are telescopically receivable within said tubular members of said upper portion and in which said biasing means comprise a pair of coiled springs mounted within said tubular members of said upper portion.

6. A ground supported wasteline cleanout tool of the character having an elongated coiled spring housed within a drum having a forward neck portion through which the coiled spring can be withdrawn and a rearward hub, said tool comprising:

(a) a frame assembly including:

(i) first and second removably interconnected base portions, said second base portion having a forward ground engaging extremity disposed proximate said first base portion and a rearward ground engaging extremity spaced apart from said first base portion;

(ii) a forward frame portion connected to said first base portion; and (iii) a rearward frame portion connected to said second base portion, said rearward frame portion rotatably supporting the drum;

(b) feed means connected to said forward frame portion for removable engagement with the coiled spring to controllably withdraw the coiled spring from the drum through the forward neck portion thereof;

(c) drive means connected to said rearward frame portion for rotating said drum about the central axis thereof; and (d) frame supporting means for supporting said frame, and for normally maintaining said second base portion elevated relative to the ground substantially parallel thereto, said drum being removable from said second frame portion upon separation of said first and second base portions, and upon tilting said second base portion forwardly to move said forward ground engaging extremity into engagement with the ground, said frame supporting means also being movable about said rearward ground engaging extremity from a first position wherein said second base portion extends angularly upwardly to permit connection and disconnection of said first and second base portions.

7. A tool as defined in claim 6, in which said frame supporting means comprises a transport assembly having:

(i) a lower portion including a pair of rearwardly extending legs and a pair of upwardly extending legs;

(ii) an upper portion including a pair of downwardly extending tubular members telescopically receivable over said upwardly extending legs of said lower portion.

8. A wasteline cleanout tool as defined in claim 7, further including biasing means for yieldably resisting upward movement of said pair of upwardly extending legs of said lower portion.

9. A wasteline cleanout tool as defined in claim 8, in which said biasing means comprise a pair of coiled springs mounted within said tubular members of said upper portion.

* * * * *